US011326806B2

(12) United States Patent
Kwon et al.

(10) Patent No.: US 11,326,806 B2
(45) Date of Patent: May 10, 2022

(54) DUCT TYPE AIR CONDITIONING DEVICE AND METHOD FOR ASSEMBLING AND DISASSEMBLING THE SAME

(71) Applicant: Samsung Electronics Co., Ltd., Suwon-si (KR)

(72) Inventors: Hyung-jin Kwon, Hwaseong-si (KR); Min-gu Jeon, Hwaseong-si (KR); Do-yeon Kim, Uiwang-si (KR); Hyun-ho Kim, Suwon-si (KR); Chul-byung Park, Ansan-si (KR); Bu-youn Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 140 days.

(21) Appl. No.: 16/151,575

(22) Filed: Oct. 4, 2018

(65) Prior Publication Data

US 2019/0030662 A1 Jan. 31, 2019

Related U.S. Application Data

(62) Division of application No. 14/883,750, filed on Oct. 15, 2015, now Pat. No. 10,571,151.

(30) Foreign Application Priority Data

Nov. 12, 2014 (KR) ..... 10-2014-0157434

(51) Int. Cl.
*F24F 13/20* (2006.01)
*F24F 13/02* (2006.01)

(52) U.S. Cl.
CPC ..... *F24F 13/20* (2013.01); *F24F 13/0209* (2013.01); *F24F 13/0245* (2013.01)

(58) Field of Classification Search
CPC ..... F24F 13/0245; F24F 13/20; F24F 13/0209
See application file for complete search history.

(56) References Cited

U.S. PATENT DOCUMENTS 2,282,373 A 5/1942 Minkler
3,630,549 A * 12/1971 Grimm ..... F16L 23/14 285/296.1

(Continued)

FOREIGN PATENT DOCUMENTS

CN 1884928 12/2006
CN 203797797 8/2014

(Continued)

OTHER PUBLICATIONS

US Office Action dated Nov. 16, 2018 in U.S. Appl. No. 14/883,750.

(Continued)

*Primary Examiner* — David J Teitelbaum
(74) *Attorney, Agent, or Firm* — Staas & Halsey LLP

(57) ABSTRACT

A duct type air conditioning apparatus is provided with a blowing portion including a first cabinet in which a blower assembly is installed and a heat exchanging portion including a second cabinet in which a heat exchanger is installed. The air conditioning apparatus includes a partition panel arranged between the first and second cabinets and connected to facing sides of the first and second cabinet, and first and second link members separably fastened along an upper end and a lower end of the partition panel to keep an airtight seal in a connection portion between the first and second cabinets.

5 Claims, 14 Drawing Sheets

(56) References Cited

U.S. PATENT DOCUMENTS

| | | | | |
|---|---|---|---|---|
| 4,476,066 | A | 10/1984 | Gollub | |
| 4,631,881 | A * | 12/1986 | Charman | E04B 2/7425 160/135 |
| 5,056,290 | A | 10/1991 | Alexander et al. | |
| 5,112,024 | A | 5/1992 | Stanko | |
| 5,638,693 | A | 6/1997 | Baek | |
| 7,805,957 | B2 | 10/2010 | Liu | |
| 8,371,460 | B2 * | 2/2013 | Ghatikar | E04B 2/7435 211/175 |
| 8,549,804 | B2 * | 10/2013 | Metcalf | E04B 2/7448 439/215 |
| 9,046,212 | B2 * | 6/2015 | Harris | A47B 96/1466 |
| 2002/0108391 | A1 | 8/2002 | Kim | |
| 2003/0160452 | A1 | 8/2003 | Mattsson | |
| 2005/0039478 | A1 | 2/2005 | Yoon | |
| 2005/0109054 | A1 | 5/2005 | Eom et al. | |
| 2008/0072613 | A1 | 3/2008 | Liu | |

FOREIGN PATENT DOCUMENTS

| | | |
|---|---|---|
| EP | 034888 | 5/1984 |
| EP | 2224184 | 9/2010 |
| EP | 2520869 | 11/2012 |
| EP | 2722609 | 4/2014 |
| JP | 59-16914 | 2/1984 |
| JP | 7-324805 | 12/1995 |
| JP | 2006-105573 | 4/2006 |
| JP | 2007-271142 | 10/2007 |
| JP | 2008-261541 | 10/2008 |
| JP | 2011-94817 | 5/2011 |
| JP | 2011-122810 | 6/2011 |
| JP | 2012-233646 | 11/2012 |
| JP | 2013-200097 | 10/2013 |
| KR | 20-0225294 | 5/2001 |
| KR | 10-1201876 | 11/2012 |

OTHER PUBLICATIONS

European Communication dated Jul. 31, 2019 in European Patent Application No. 15858632.1.

Chinese Office Action dated May 28, 2019 in Chinese Patent Application No. 201510769905.X.

US Office Action dated Apr. 29, 2019 in U.S. Appl. No. 14/883,750.

International Search Report and Written Opinion of the International Searching Authority dated Feb. 17, 2016 in International Patent Application No. PCT/KR2015/011684.

Australian Office Action dated Dec. 5, 2017 in Australian Patent Application No. 2015347519.

Extended European Search Report dated Jun. 28, 2018 in European Patent Application No. 15858632.1.

US Office Action dated Jul. 2, 2018 in U.S. Appl. No. 14/883,750.

U.S. Appl. No. 14/883,750, filed Oct. 15, 2015, Hyung-jin Kwon, et al., Samsung Electronics Co., LTD.

US Notice of Allowance dated Nov. 6, 2019 in U.S. Appl. No. 14/883,750.

Notice of Allowance dated Sep. 16, 2021, in Korean Patent Application No. 10-2014-0157434.

* cited by examiner

DUCT TYPE AIR CONDITIONING DEVICE AND METHOD FOR ASSEMBLING AND DISASSEMBLING THE SAME

CROSS-REFERENCE TO RELATED APPLICATIONS

This application is a divisional application of U.S. patent application Ser. No. 14/883,750, filed Oct. 15, 2015, which claims priority under 35 U.S.C. § 119(a) to Korean Patent Application No. 10-2014-0157434, filed on Nov. 12, 2014, in the Korean Intellectual Property Office, the disclosures of which are incorporated herein by reference.

BACKGROUND

1. Field

The present disclosure relates generally to a duct type air conditioning device, and more particularly to a duct type air conditioning device which reduces the number of fastening screws that are used to connect a blowing portion and a heat exchanging portion to each other and intercepts air leakage that occurs in a connection portion between the blowing portion and the heat exchanging portion in an indoor unit of a ceiling embedded duct type air conditioning device in a state where the blowing portion and the heat exchanging portion are mutually connected to each other.

2. Description of the Related Art

In general, as illustrated in FIG. 1, an indoor unit of a ceiling embedded air conditioner that is installed to be embedded in the ceiling of a building is composed of a heat exchanging portion 10 including a first box-shaped cabinet 3 having a heat exchanger 1 built therein, a blower assembly 11 sucking and blowing indoor air toward the heat exchanger 1, and a blowing portion 20 including a second cabinet 13 having the blower assembly 11 built therein.

The blower assembly 11 is installed on a partition panel 30 partitioning the first and second cabinets 3 and 13, and a pair of fan casings 11*a* is coupled to a ventilation port 31 of the partition panel 30. A pair of blowing fans 11*b* is installed inside the pair of fan casings 11*a*. A motor (not illustrated) for driving the pair of blowing fans 11*b* is arranged between the pair of fan casings 11*a*.

The above-described blower assembly 11 is fixed to the first cabinet 3 through fastening of a plurality of fixing screws along the circumference of the partition panel 30 in a state where the partition panel 30 comes in close contact with the first cabinet 3.

On the other hand, if the blowing fan 11*b*, the motor, or the heat exchanger 1 gets out of order while using the indoor unit of the air conditioner in the related art that is installed to be embedded in the ceiling, an upper plate 3*a* of the first cabinet 3 or an upper plate 13*a* of the second cabinet 13 may be separated for repairs. In this case, the repairing work time may be lengthened due to a large number of fixing screws 40 that are used to fix the upper plate.

Because the upper plate 3*a* of the first cabinet 3 is constructed to be directly fastened to the partition panel 30 simply by the fixing screws 40, an airtight seal may not be properly kept in a connection portion between the upper plate 3*a* of the first cabinet 3 and the partition panel 30 to cause air leakage to occur in the connection portion.

Further, according to a duct type air conditioner in the related art, in order to connect a coupling portion that is formed at a lower end of the cabinet on the side of the heat exchanging portion into a coupling groove that is formed at a lower end of the cabinet on the side of the blowing portion for mutual connection between the blowing portion and the heat exchanging portion, it is required to insert the coupling portion of the cabinet on the side of the heat exchanging portion into the coupling groove of the cabinet on the side of the blowing portion after lifting the cabinet on the side of the heat exchanging portion with a predetermined height.

However, because the blowing portion and the heat exchanging portion are heavy, at least two workers are necessary to perform the connection work. In addition, a large number of fixing screws are used to connect the respective cabinets on the sides of the blowing portion and the heat exchanging portion. Due to this, workability is considerably deteriorated.

SUMMARY

The present disclosure has been made to address at least the above problems and/or disadvantages and to provide at least the advantages described below. Accordingly, an aspect of the present disclosure provides a duct type air conditioning apparatus, which may minimize the number of fixing screws that are used to connect a blowing portion and a heat exchanging portion to each other and keep an airtight seal in a connection portion between the blowing portion and the heat exchanging portion.

An aspect of the present disclosure provides a duct type air conditioning apparatus, which may facilitate connection and disconnection of a blowing portion and a heat exchanging portion.

According to an aspect of the present disclosure, a duct type air conditioning apparatus, provided with a blowing portion including a first cabinet in which a blower assembly is installed and a heat exchanging portion including a second cabinet in which a heat exchanger is installed, includes a partition panel arranged between the first and second cabinets and connected to facing sides of the first and second cabinet; and first and second link members separably fastened along an upper end and a lower end of the partition panel to keep an airtight seal in a connection portion between the first and second cabinets.

Each of the first and second link members may include a center portion separably connected to the partition panel; a first extension portion extending toward the first cabinet; and a second extension portion extending toward the second cabinet, wherein the first and second extension portions of the first and second link members come in close contact with upper and lower plates of the first and second cabinets to form multiple airtight points.

The first and second extension portions of the first and second link members may be inserted into first and second groove portions that are formed on the upper and lower plates of the first and second cabinets in a state where the first and second extension portions are circumscribed on the first and second groove portions.

The first and second extension portions may be formed to be bent in multistage or to be curved in a winding shape.

The first and second extension portions may be arranged to be inclined in a flat plate shape.

Upper plates of the first and second cabinets may simultaneously come in close contact with the first link member and an upper end portion of the partition panel, and lower plates of the first and second cabinets may simultaneously come in close contact with lower end portions of the second link member and the partition panel.

Upper plates and lower plates of the first and second cabinets may respectively come in close contact with upper end portions and lower end portions of frames of the first and second cabinets to form multiple airtight points.

Locking portions may be formed on the upper end portions and the lower end portions of the frames of the first and second cabinets to project toward the upper plates and the lower plates of the first and second cabinets, and groove portions may be formed on the upper plates and the lower plates of the first and second cabinets so that the locking portions of the respective frames are inserted into the groove portions. In this case, the locking portions may be circumscribed on the groove portions.

Each of the first and second link members may include a center portion separably connected to the partition panel; a first extension portion extending toward the first cabinet; and a second extension portion extending toward the second cabinet, wherein any one of the first and second extension portions is integrally formed on upper and lower plates of the first and second cabinets and the other of the first and second extension portions comes in close contact with other upper and lower plates of the first and second cabinets to form multiple airtight points.

According to an aspect of the present disclosure, a duct type air conditioning apparatus, provided with a blowing portion including a first cabinet in which a blower assembly is installed and a heat exchanging portion including a second cabinet in which a heat exchanger is installed, includes a partition panel arranged between the first and second cabinets and connected to facing sides of the first and second cabinet; and at least one link member separably fastened along at least one of an upper end portion and a lower end portion of the partition panel to make an airtight seal in a connection portion between the first and second cabinets in multiple ways.

Both sides of the at least one link member may be inserted into groove portions formed on any one of upper and lower plates of the first and second cabinets in a state where the both sides of the at least one link member are inscribed on the groove portions.

At least one of upper and lower plates of the first and second cabinets may come in close contact with upper end portions or lower end portions of frames of the first and second cabinets to form multiple airtight points.

According to an aspect of the present disclosure, a duct type air conditioning apparatus, provided with a blowing portion including a first cabinet in which a blower assembly is installed and a heat exchanging portion including a second cabinet in which a heat exchanger is installed, includes a partition panel arranged between the first and second cabinets and connected to facing sides of the first and second cabinet; and first and second link members separably fastened to an upper end portion and a lower end portion of the partition panel to keep an airtight seal in a connection portion between the first and second cabinets in multiple ways.

Upper and lower plates of the second cabinet may respectively come in close contact with upper and lower end portions of a frame of the second cabinet to form multiple airtight points.

BRIEF DESCRIPTION OF THE DRAWINGS

The above and other aspects, features and advantages of the present disclosure will be more apparent from the following detailed description when taken in conjunction with the accompanying drawings, in which.

DETAILED DESCRIPTION

Figure 1:
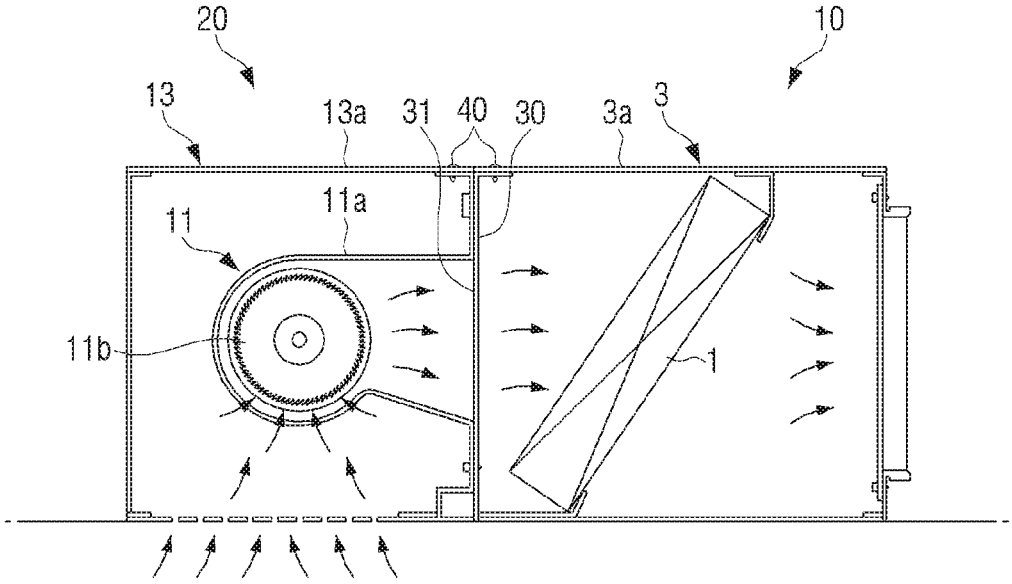
FIG. 1 is a cross-sectional view illustrating a duct type air conditioning apparatus in the related art.

Hereinafter, embodiments of the present disclosure will be described in detail with reference to the accompanying drawings. In the drawings, to help the understanding of the present disclosure, sizes of some constituent elements may be exaggerated for clarity in explanation.

Figure 2:
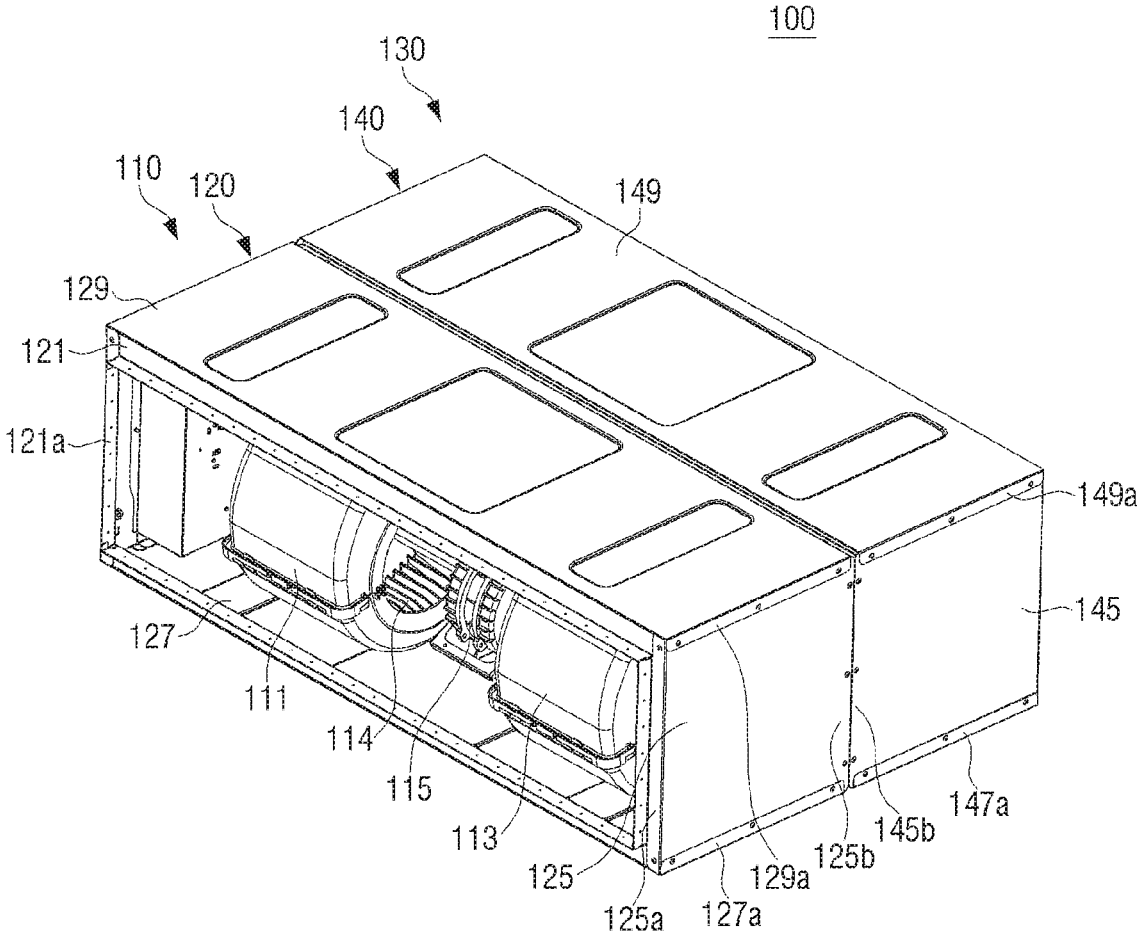
FIGS. 2 and 3 are perspective views illustrating a duct type air conditioning apparatus according to an embodiment of the present disclosure.
Figure 3:
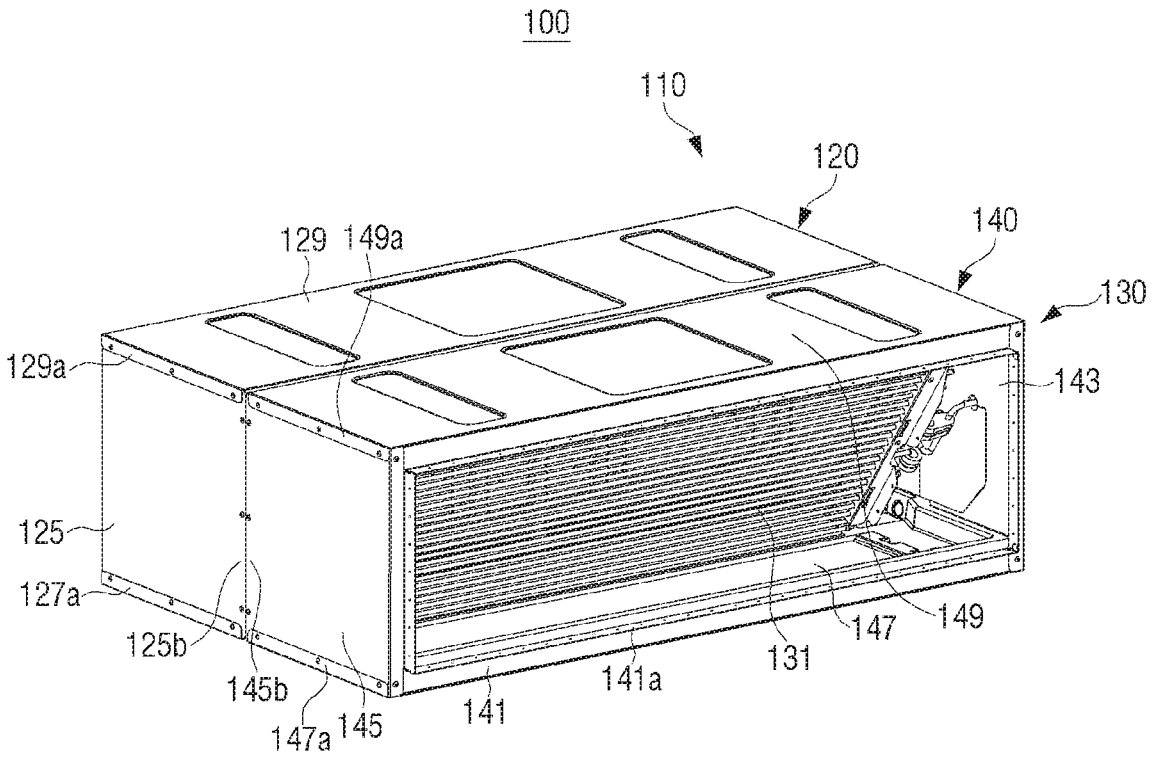

FIGS. 2 and 3 illustrate a duct type air conditioning apparatus 100 according to an embodiment of the present disclosure. FIG. 2 is a perspective view as seen looking toward a blowing portion 110, and FIG. 3 is a perspective view as seen looking toward a heat exchanging portion 130.

A duct type air conditioning apparatus 100 according to an embodiment of the present disclosure includes a blowing portion 110 and a heat exchanging portion 130, which are separably connected to each other.

Referring to FIGS. 2 and 3, the blowing portion 110 includes a pair of blower assemblies 111 and 113, and a motor 115 arranged between the pair of blower assemblies 111 and 113 to drive fans 114 that are respectively provided in the pair of blower assemblies 111 and 113. Further, the blowing portion 110 includes a first cabinet 120 that surrounds the pair of blower assemblies 111 and 113 and the motor 115.

Figure 4:
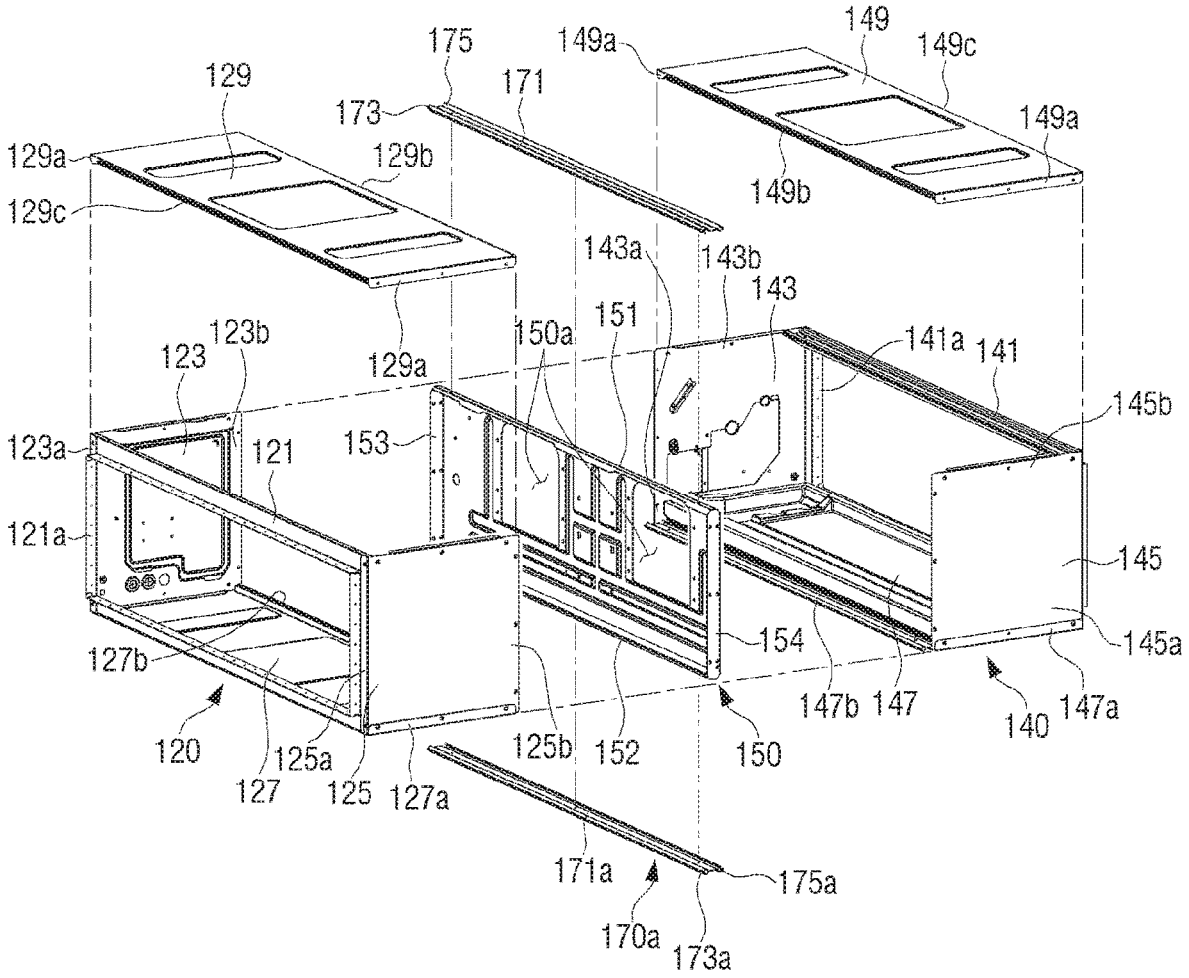
FIG. 4 is an exploded perspective view illustrating a first cabinet of a blowing portion and a second cabinet of a heat exchanging portion.

Referring to FIG. 4, the first cabinet 120 includes a frame 121, a left plate 123 and a right plate 125 having end portions 123*a* and 125*a* connected to the frame 121 by fixing screws, a lower plate 127 having both end portions 127*a* fastened to lower end portions of the left plate 123 and the right plate 125 by fixing screws, and an upper plate 129 having both end portions 129*a* fastened to upper end portions of the left plate 123 and the right plate 125 by fixing screws. The frame 121 is roughly in a rectangular shape, and a connection portion 121*a*, to which a duct (not illustrated) is connected, is formed on the frame 121. Other end portions 123*b* and 125*b* of the left plate 123 and the right plate 125 are fastened by fixing screws to both end portions 153 and 154 of a partition portion 150 to be described later.

Figure 5:
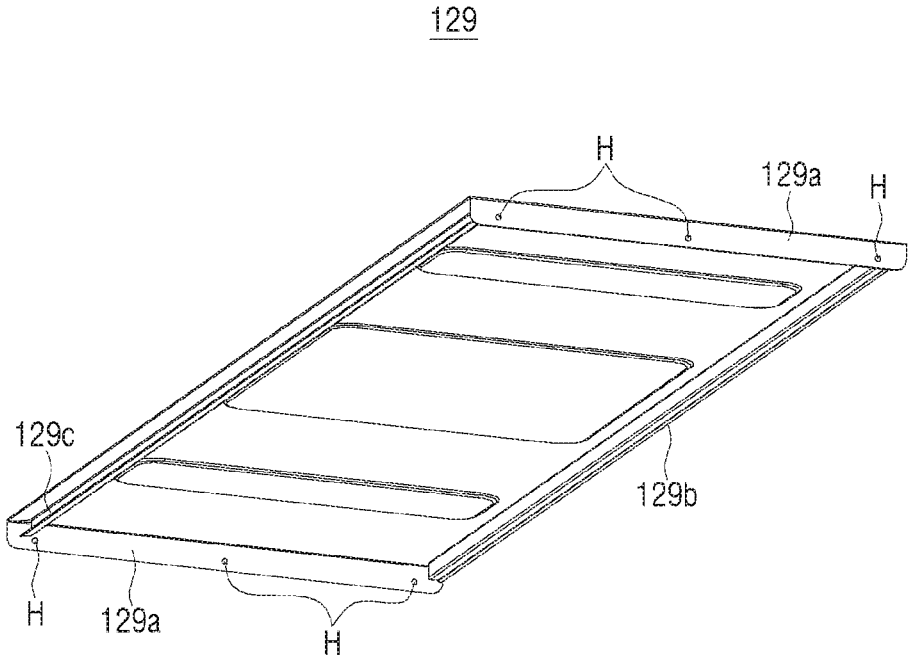
FIG. 5 is a perspective view illustrating an upper plate of a first cabinet.

Referring to FIG. 5, a first groove portion 129*b*, into which a first extension portion 173 of a first link member 170 is inserted, is formed on one end portion of the upper plate 129 of the first cabinet 120, which is connected to the first link member 170, and a second groove portion 129*c*, into which a locking portion 121*c* (see FIG. 8) that is formed on the frame 121 is separably inserted, is formed on the other end portion of the upper plate 129 that comes in contact with the side of the frame 121. Screw holes H, to which fixing screws are fastened, are penetratingly formed at three points of each of the both end portions 129*a* of the upper plate 129.

Hereinafter, referring to FIGS. 6 to 8, the structure of the first groove portion 129*b* and the second groove portion 129*c* of the first cabinet 120 as described above will be described in detail.

Figure 7:
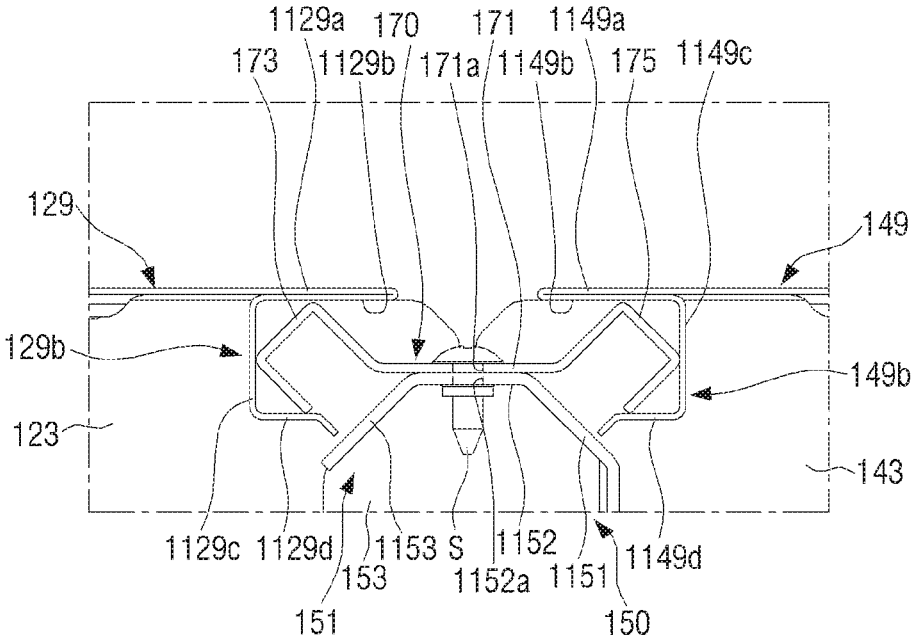
FIG. 7 is an enlarged view of a portion VII illustrated in FIG. 6, and particularly, an enlarged cross-sectional view illustrating a connection state between upper plates of first and second cabinets through a link member.

Referring to FIG. 7, the first groove portion 129*b* of the first cabinet 120 is bent in multistage to be opened toward the partition portion 150. That is, the first groove portion 129*b* includes a first portion 1129*b* which extends from one end portion 1129*a* of the upper plate 129 and is folded to an opposite side of the one end portion 1129*a*, a second portion 1129*c* which extends from the first portion 1129*b* and is bent downward at right angles, and a third portion 1129*d* which extends from the second portion 1129*c* and is bent toward the partition panel 150. In this case, the first groove portion 129*b* is formed with a size to the extent that the first extension portion 173 of the first link member 170 can come in contact with the inside of the first groove portion 129*b*. The first groove portion 129*b* as constructed above may keep, or form, an airtight seal between the first cabinet 120 and the partition panel 150 together with the first link member 170.

Although not illustrated in the drawing, in the same manner as the one end portion 1129*a* of the upper plate 129 as described above, a third groove portion, which is provided in the same manner as the first groove portion 129*b* of the upper plate 129, is formed on one end portion of the lower plate 127, and a first extension portion 173 of a second link member 170*a* is inserted into the third groove portion to come in contact with the third groove portion. Further, in the same manner as the other end portion 1129*c* of the upper plate 129 as described above, a fourth groove portion is formed on the other end portion of the lower plate 127. Accordingly, the upper plate 129 and the lower plate 127 of the first cabinet 120 may keep an airtight seal in a portion that is connected to the partition panel 150 and a portion that is connected to the frame 121.

Figure 6:
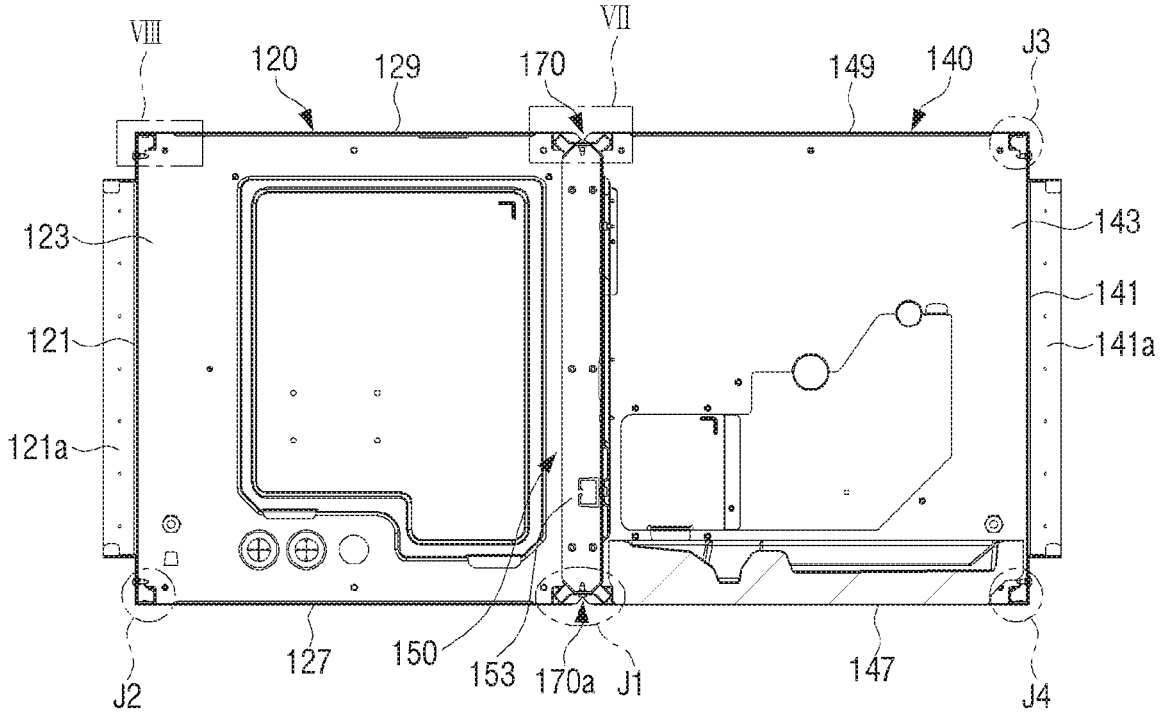
FIG. 6 is a cross-sectional view illustrating a structure in which first and second cabinets of a duct type air conditioning apparatus according to an embodiment of the present disclosure are mutually connected through a link member.

The connection structure of a portion J1, to which the second link member 170*a* is coupled, as illustrated in FIG. 6 is the same as the above-described structure of FIG. 7.

Figure 8:
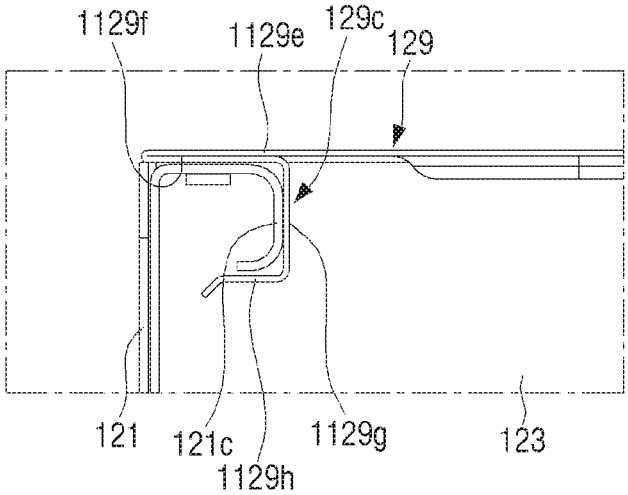
FIG. 8 is an enlarged view of a portion VIII illustrated in FIG. 6, and particularly, an enlarged cross-sectional view illustrating a connection state between an upper plate of a first cabinet and a frame.

Referring to FIG. 8, in the same manner as the first groove portion 129*b*, the second groove portion 129*c* of the first cabinet 120 is bent in multistage to be opened toward an upper end of the frame 121 so that the locking portion 121*c* is inserted into the second groove portion 129*c*.

The second groove portion 129*c* includes a fourth portion 1129*f* which extends from the other end portion 1129*e* of the upper plate 129 and is folded to an opposite side of the other end portion 1129*e*, a fifth portion 1129*g* which extends from the fourth portion 1129*f* and is bent downward at right angles, and a sixth portion 1129*h* which extends from the fifth portion 1129*g* and is bent toward the partition panel 150. In this case, the second groove portion 129*c* is formed with a size to the extent that the locking portion 121*c* of the frame 121 can come in contact with the inside of the second groove portion 129*c*. The second groove portion 129*c* as constructed above can keep an airtight seal between the first cabinet 120 and the frame 121 together with the first link member 170.

Further, portions of the upper plate 129, which are fastened by fixing screws when the first cabinet 120 is assembled, are limited to three points (using 6 fixing screws in total) for each of the both end portions 129*a* of the upper plate 129, and thus the number of fixing screws being used can be greatly reduced in comparison to the duct type air conditioning apparatus in the related art. Accordingly, time for disassembling and assembling the upper plate 129, which is required when components arranged inside the first cabinet 120 of the blower portion 110 are repaired or replaced, can be shortened.

In the same manner as the upper plate 129, portions of the lower plate 127, which are fastened by fixing screws when the first cabinet 120 is assembled, are limited to three points (using 6 fixing screws in total) for each of the both end portions 127*a* of the lower plate 127, and thus the number of fixing screws being used can be greatly reduced in comparison to the duct type air conditioning apparatus in the related art.

Each connection structure of portions J2, J3, and J4 as illustrated in FIG. 6 is the same as the above-described structure of FIG. 8.

Referring to FIG. 3, the heat exchanging portion 130 includes a heat exchanger 131 and a second cabinet 140. The heat exchanger 131 is arranged to be inclined in the second cabinet 140.

Referring to FIG. 4, the second cabinet 140 is formed in the same manner as the first cabinet 120 as described above. That is, the second cabinet 140 includes a frame 141, a left plate 143 and a right plate 145 having end portions 143*a* and 145*a* connected to the frame 141 by fixing screws, a lower plate 147 having both end portions 147*a* fastened to lower end portions of the left plate 143 and the right plate 145 by fixing screws, and an upper plate 149 having both end portions 149*a* fastened to upper end portions of the left plate 143 and the right plate 145 by fixing screws. The frame 141 is roughly in a rectangular shape, and a connection portion 141*a*, to which a predetermined duct (not illustrated) is connected, is formed on the frame 141. Other end portions 143*b* and 145*b* of the left plate 143 and the right plate 145 are fastened to both end portions 153 and 154 of a partition portion 150 to be described later by fixing screws.

The upper plate 149 of the second cabinet 140 has the same structure as the upper plate 149 of the first cabinet 140 as described above. That is, a first groove portion 149*b*, into which a second extension portion 175 of the first link member 170 is inserted, is formed on one end portion of the upper plate 149 of the second cabinet 140, which is connected to the first link member 170, and a second groove portion 149*c*, into which a locking portion (not illustrated) that is formed on the frame 141 is separably inserted, is formed on the other end portion of the upper plate 149 that comes in contact with the side of the frame 141.

Because the lower plate 147 of the second cabinet 140 has the same construction as the upper plate 149 of the second cabinet 140, the detailed explanation thereof will be omitted.

Please be advised that reference numeral 1149A in FIG. 7, which has not been described, refers to a one end portion of the second groove portion 149*c*, 1149*b* refers to the first portion of the second groove portion, 1149*c* refers to the second portion of the second groove portion, and 1149*d* refers to the third portion of the second groove portion.

In the same manner as the upper plate 129 and the lower plate 127 of the first cabinet 120 as described above, the upper plate 149 and the lower plate 147 of the second cabinet 140 can keep an airtight seal in connection portions with the frame 141 and the partition panel 150, and the number of fixing screws being used can be greatly reduced in comparison to the duct type air conditioning apparatus in the related art.

The insides of the first and second cabinets 120 and 140 are partitioned by the partition panel 150. A pair of air discharge ports 150*a* are formed on the partition panel 150 to make a pair of blower assemblies 111 and 113 communicate with each other.

Referring to FIG. 4, a first link member 170 and a second link member 170*a* are separably coupled to an upper end portion 151 and a lower end portion 152 of the partition panel 150 by fixing screws. As illustrated in FIG. 7, the upper end portion 151 of the partition panel 150 is formed to be bent in multistage. That is, inclined portions 1151 and 1153 are formed on both sides of the upper end portion 151 of the partition panel 150, and a horizontal portion 1152 is formed to be connected between the pair of inclined portions 1151 and 1153.

In this case, a screw hole 1152*a*, to which a fixing screw S is fastened, is formed on the horizontal portion 1152. In this case, a screw hole 171*a* that corresponds to the screw hole 1152*a* is formed on the center portion 171 of the first link member 170. The number of screw holes 1152*a* and 171*a* may be, for example, three. However, at least two screw holes 1152*a* and 171*a* are enough to maintain fastening force between the partition panel 150 and the first link member 170.

The pair of inclined portions 1151 and 1153 are arranged to be inclined downward from the horizontal portion 1152 so that they do not interfere with the first groove portions 129*b* and 149*b* of the upper plates 129 and 149 of the first and second cabinets 120 and 140.

The second link member 170*a* is fixed to the lower end portion 152 of the partition panel 150 by a plurality of fixing screws. Because the lower end portion 152 of the partition panel 150 has the same structure as the upper end portion 151 of the partition panel 150 as described above, the explanation thereof will be omitted.

Further, the both end portions 153 and 154 of the partition panel 150 are respectively fastened to the left plates 123 and 143 of the first and second cabinets 120 and 140 and the right plates 125 and 145 of the first and second cabinets 120 and 140 by fixing screws. Accordingly, the partition panel 150 serves as a medium that separably connects the first and second cabinets 120 and 140 to each other.

Referring to FIGS. 4 and 7, the center portion 171 of the first link member 170 is separably fastened along the upper end portion 151 of the partition panel 150 through a plurality of fixing screws. The first extension portion 173, which is inserted into the first groove portion 129*b* of the upper plate 129 of the first cabinet 120 in an airtight state, is formed on one side of the center portion 171 of the first link member 170, and the second extension portion 175, which is inserted into the first groove portion 149*b* of the upper plate 149 of the second cabinet 140 in an airtight state, is formed on the other side of the center portion 171.

The first extension portion 173 extends from the center portion 171 and is bent in multistage in a downwardly winding shape. In this case, because corners of a plurality of bent portions of the first extension portion 173 come in close contact with the inner surface of the first groove portion 129*b* of the upper plate 129 of the first cabinet 120 when the first extension portion 173 is inserted into the first groove portion 129*b* as described above, multiple airtight points can be formed between the upper plate 129 of the first cabinet 120 and the upper end portion 151 of the partition panel 150, and thus an airtight seal can be greatly improved.

In the same manner as the first extension portion 173 as described above, the second extension portion 175 extends from the center portion 171 and is bent in multistage in a downwardly winding shape. Because corners of a plurality of bent portions of the second extension portion 175 also come in close contact with the inner surface of the first groove portion 149*b* of the upper plate 149 of the second cabinet 140 when the second extension portion 175 is inserted into the first groove portion 149*b*, multiple airtight points can be formed between the upper plate 149 of the second cabinet 140 and the upper end portion 151 of the partition panel 150, and thus an airtight seal can be greatly improved.

FIG. 7 illustrates that the first and second extension portions 173 and 175 are bent in three stages, but are not limited thereto. The first and second extension portions 173 and 175 may be bent in two stages or in four or more stages to come in close contact with the first groove portions 129*b* and 149*b* at multiple points, and thus an airtight seal can be maintained.

The second link member 170*a* is fastened to the lower end portion 152 of the partition panel 150, and in the same manner as the first link member 170 as described above, first and second extension portions 173*a* and 175*a* are formed to be bent in multistage in a winding shape on both sides of the center portion 171*a* of the second link member 170*a*. In this case, the first and second extension portions 173*a* and 175*a* are inserted into the first groove portions 127*b* and 147*b* of the lower plates 127 and 147 of the second cabinet in an airtight state.

As described above, according to the duct type air conditioning apparatus 100 according to an embodiment of the present disclosure as constructed above, an airtight seal can be improved in connection portions between the upper plates 129 and 149 and the lower plates 127 and 147 of the cabinets 120 and 140 and the partition panel 150 and connection portions between the upper plates 129 and 149 and the lower plates 127 and 147 of the cabinets 120 and 140 and the frames 121 and 141.

Further, the number of fixing screws that are used for the connection portions between the upper plates 129 and 149 and the lower plates 127 and 147 of the cabinets 120 and 140 and the partition panel 150 and connection portions between the frames 121 and 141 can be greatly reduced in comparison to that according to the duct type air conditioning apparatus in the related art.

Hereinafter, referring to FIGS. 9 and 10, a process of separating the upper plate 129 from the first cabinet 120 is described.

First, a plurality of fixing screws that are fastened to the both end portions 129*a* of the upper plate 129 are loosened, and a plurality of fixing screws that are fastened to the first link member 170 are loosened.

Figure 9:
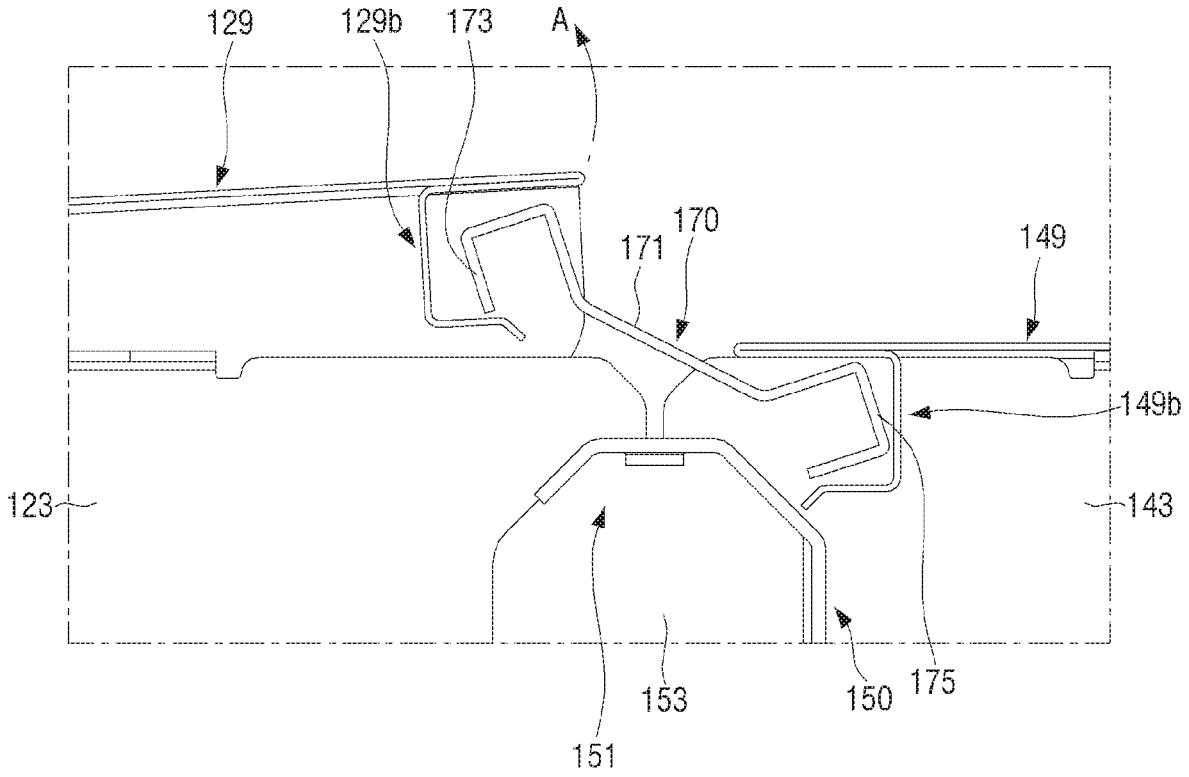
FIG. 9 is an enlarged cross-sectional view illustrating a separation state between an upper plate of a first cabinet and a link member during separation of the upper plate of the first cabinet.

Then, as illustrated in FIG. 9, if the first groove portion 129*b* of the upper plate 129 is lifted up in a direction A, the first link member 170 is rotated clockwise about the second extension portion 175 as a rotating shaft in association with the lifting of the first groove portion 129*b*.

In continuation, if the first groove portion 129*b* is rotated in the direction A, the first extension portion 173 of the first link member 170 secedes from the first groove portion 129*b*, and then returns to its original position by the self weight thereof. If the upper plate 129 is pulled toward the second cabinet 140 in a state where the first extension portion 173 of the first link member 170 has completely seceded from the first groove portion 129*b*, the second groove portion 129*c* of the upper plate 129 is separated from the locking portion 121*c* of the frame 121, and thus the upper plate 129 is completely separated from the first cabinet 120.

Figure 10:
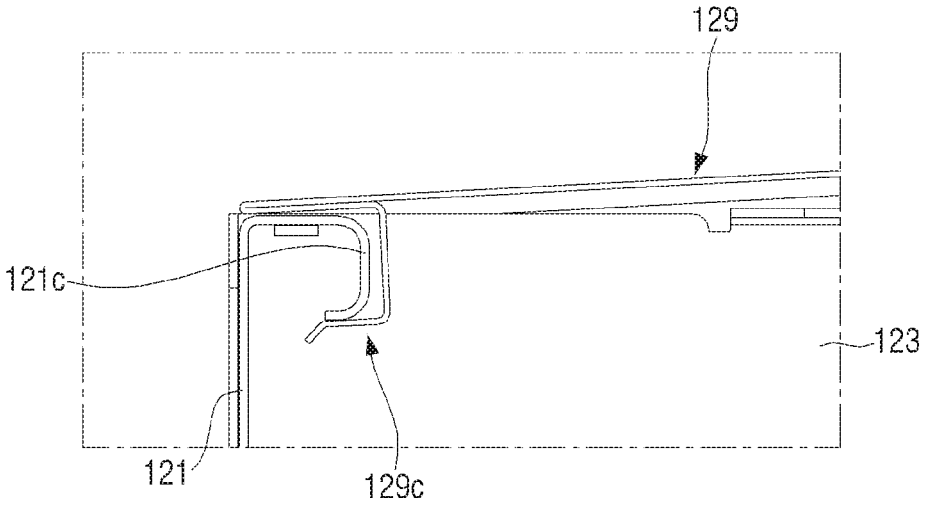
FIG. 10 is an enlarged cross-sectional view illustrating a separation state between an upper plate of a first cabinet and a frame during separation of the upper plate of the first cabinet.

On the other hand, when the side of the first groove portion 129*b* of the upper plate 129 is rotated in the direction A, as shown in FIG. 10, the locking portion 121*c* of the frame 121 that is inserted into the second groove portion 129*c* of the upper plate 129 serves as a rotating center of the upper plate 129.

Accordingly, a user can separate the upper plate 129 from the first cabinet 120 through a simple work in a short time.

In contrast, in the case of mounting the upper plate 129 on the first cabinet 120, the process of separating the upper plate 129 from the first cabinet 120 is performed in reverse order. That is, after the locking portion 121*c* of the frame 121 is inserted into the second groove portion 129*c* of the upper plate 129, the first groove portion 129*b* of the upper plate 129 is rotated toward the first link member 170 in reverse direction to the direction "A as indicated in FIG. 9 about the locking portion 121*c* of the frame 121 as a rotating center.

After the first groove portion 129*b* of the upper plate 129 is moved to a position that is adjacent to the first link member 170 as described above, the first extension portion 173 of the first link member 170 is lifted up to be inserted into the first groove portion 129*b* of the upper plate 129. Then, the first groove portion 129*b* of the upper plate 129 is rotated in the direction A so that the both end portions 129*a* are seated on upper ends of the left and right plates 123 and 125.

Thereafter, the first link member 170 is fastened to the upper end portion 151 of the partition panel 150 using fixing screws, and the both end portions 129*a* of the upper plate 129 are fastened to the left plate 123 and the right plate 125 by fixing screws to complete coupling of the upper plate 129 to the first cabinet 120.

Further, according to the duct type air conditioning apparatus 100, upper and lower structures of the first and second cabinets 120 and 140 are the same, and thus the blower portion 110 and the heat exchanging portion 130 can be easily connected to each other without inconvenience of lifting any one of them. That is, in the case of connecting the first and second cabinets 120 and 140 of the duct type air conditioning apparatus 100, the left plates 123 and 143 and the right plates 125 and 145 of the first and second cabinets 120 and 140 can be simply fastened to the both end portions 153 and 154 of the partition panel 150 by fixing screws in a state where the first and second cabinets 120 and 140 are pushed in a direction in which they face each other and come in contact with each other. Accordingly, in the case of connecting or disconnecting the blower portion 110 and the heat exchanging portion 130, even only one worker can promptly and easily perform the connection work without any effort.

Hereinafter, referring to FIGS. 11 to 14, various types of link members 270, 370, 470, and 570 will be described in order. In addition, with respect to the link members 270, 370, 470, and 570, a pair of them may be provided to correspond to the upper end portion and the lower end portion of the partition panel. Hereinafter, only the link member that corresponds to the upper end portion of the partition panel will be described.

Figure 11:
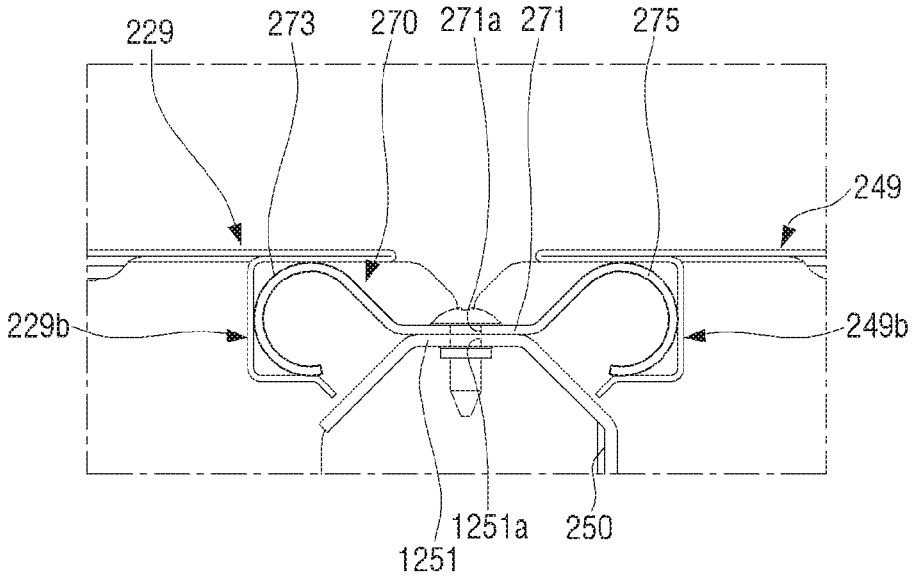
FIGS. 11, 12, 13, and 14 are partial enlarged cross-sectional views illustrating a structure in which first and second cabinets are mutually connected through link members.

Referring to FIG. 11, a link member 270 is similar to the link members 170 and 170*a*, and includes a center portion 271 fastened by fixing screws along an upper end portion of a partition panel 250, and first and second extension portions 273 and 275 formed on both sides of the center portion 271 in a winding shape.

The first and second extension portions 273 and 275 are formed to be curved with a predetermined curvature. In this case, the first and second extension portions 273 and 275 are respectively inserted into first groove portions 229*b* and 249*b* in a state where outsides of the first and second extension portions 273 and 275 come in contact with inner surfaces of the first and second groove portions 229*b* and 249*b* of upper plates 229 and 249. As described above, in the same manner as the link members 170 and 170*a*, the link member 270 comes in close contact with the inner surfaces of the first groove portions 229*b* and 249*b* in a state where the link member 270 is circumscribed at three points of the inner surfaces of the first groove portions 229*b* and 249*b* to form multiple airtight points.

FIG. 11 illustrates that the first and second extension portions 273 and 275 are formed substantially in a circular shape, but are not limited thereto. It is also possible to produce the first and second extension portions 273 and 275 in a ragged shape having a curvature, such as an elliptical shape or a wave shape, and in this case, the first and second extension portions 273 and 275 come in close contact with the insides of the first groove portions 229*b* and 249*b* at multiple points in a state where the first and second extension portions 273 and 275 are circumscribed on the insides of the first groove portions 229*b* and 249*b*, and thus an airtight seal can be maintained.

On the other hand, at least two screw holes 271*a* and 1251*a* are formed on the link member 270 so that the center portion 271 and the upper end portion 1251 of the partition panel 250 are fastened by fixing screws.

In the same manner as the link members 170 and 170*a*, the link member 270 as constructed above facilitates separation of the upper plates 229 and 249 when the upper plates 229 and 249 are separated from the first and second cabinets.

Further, although not illustrated, groove portions are formed on rear end portions of the upper plates 229 and 249, and locking portions that are formed on the first and second frames are circumscribed and inserted into the groove portions. In this case, the locking portions may form at least three airtight points on inner surfaces of the groove portions.

On the other hand, it is described that the link member 270 is installed only on the upper end portion of the partition panel 250, but is not limited thereto. The link member 270 may also be separably installed on a lower end portion of the partition panel 250 through an additional link member (not illustrated). In this case, the additional link member has the same structure as that of the link member 270 as described above, and one end portion of each lower plate (not illustrated) that comes in contact with the additional link member has the same airtight structure as that formed between the above-described link member 270 and the upper plates 229 and 249. Further, the other end portions of the lower plates may have the same airtight structure as that formed between the rear end portions of the upper plates 229 and 249 and the frames.

Because an air conditioning apparatus that adopts the link member 270 has the same assembling and disassembling processes as those of an air conditioning apparatus that adopts the link member 170 as described above, the explanation thereof will be omitted.

Figure 12:
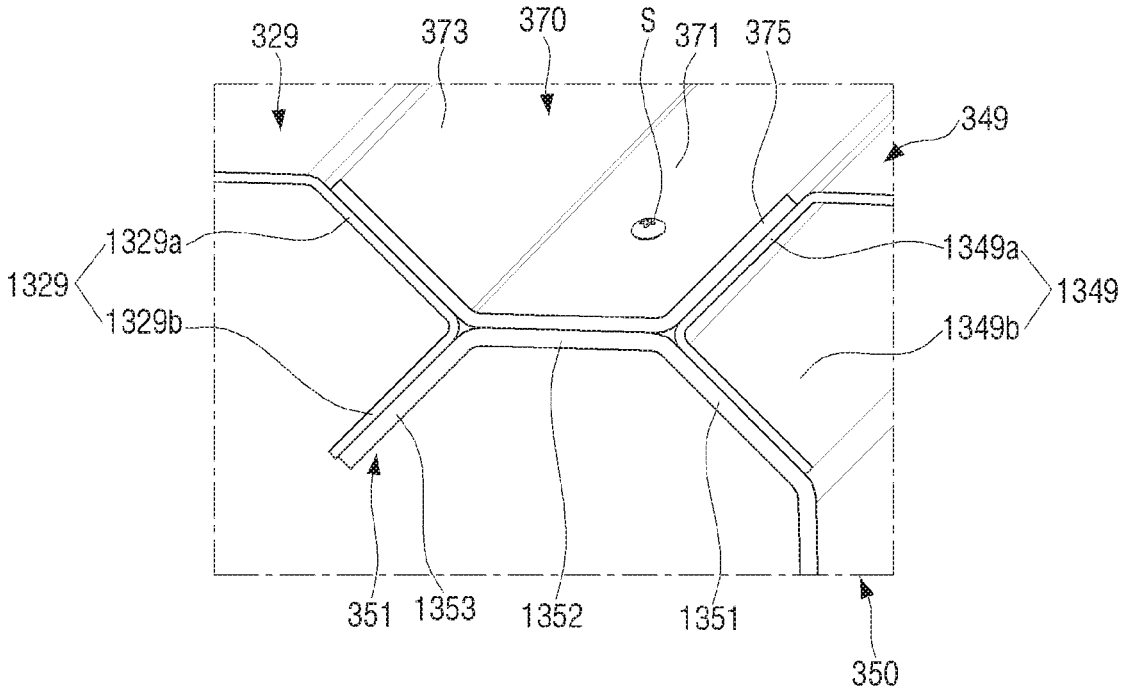

Referring to FIG. 12, a link member 370 includes a center portion 371 and first and second extension portions 373 and 375 in a flat plate shape, which are formed on both sides of the center portion 371 to be upwardly inclined at a predetermined angle.

An upper end portion 351 of a partition panel 350 includes a horizontal portion 1352 on which the center portion 371 of the link member 370 is seated in a state where the upper end portion 351 of the partition panel 350 and the center portion 371 of the link member 370 come in close contact with each other, and first and second inclined portions 1351 and 1353 that are formed on both sides of the horizontal portion 1352 to be inclined downward.

Upper plates 329 and 349 of first and second cabinets include bent portions 1329 and 1349 that are formed to extend toward the link member 370.

In this case, the bent portion 1329 of the upper plate 329 of the first cabinet includes a first portion 1329*a* that comes in close contact with the first extension portion 373 of the link member 370, and a second portion 1329*b* which extends from the first portion 1329*a* and comes in close surface contact with the second inclined portion 1353 of the upper end portion 351 of the partition panel 350. Further, the bent portion 1349 of the upper plate 349 of the second cabinet includes a second portion 1349*a* that comes in close surface contact with the second extension portion 375 of the link member 370, and a second portion 1349*b* which extends from the second portion 1349*b* and comes in close surface contact with the first inclined portion 1351 of the upper end portion 351 of the partition panel 350.

Accordingly, in the case of adopting the link member 370, multiple airtight points are formed between the bent portions 1329 and 1349 of the first and second upper plates 329 and 349 and the upper end portion 351 of the partition panel 350.

Although not illustrated in the drawing, groove portions are formed on rear end portions of the upper plates 329 and 349, and locking portions that are formed on the first and second frames are circumscribed and inserted into the groove portions. In this case, the locking portions may form at least three airtight points on inner surfaces of the groove portions.

On the other hand, it is described that the link member 370 is installed only on the upper end portion of the partition panel 350, but is not limited thereto. The link member 370 may also be separably installed on a lower end portion of the partition panel 350 through an additional link member (not illustrated). In this case, the additional link member has the same structure as that of the link member 370 as described above, and one end portion of each lower plate (not illustrated) that comes in contact with the additional link member has the same airtight structure as that formed between the above-described link member 370 and the upper plates 329 and 349. Further, the other end portions of the lower plates may have the same airtight structure as that formed between the rear end portions of the upper plates 329 and 349 and the frames.

In the case of an air conditioning apparatus that adopts the link member 370, a method for assembling first and second cabinets is as follows.

First, the partition panel 350 is fastened to any one of the first and second cabinets by fixing screws.

Then, the remaining cabinet is moved along the same plane toward the cabinet to which the partition panel 350 has been fastened so that the remaining cabinet faces the partition panel 350, and then the remaining cabinet is connected to the partition panel 350 through the remaining fixing screws.

In this state, the upper plates 329 and 349 of the first and second cabinets are fastened to upper ends of left and right plates of the first and second cabinets. In this case, end portions of the upper plates of the first and second cabinets come in close surface contact with the partition panel 350 to form an airtight seal.

In continuation, the link member 370 is fastened through fixing screws in a state where the link member 370 is seated on the upper end portion of the partition panel 350. In this case, the first and second extension portions 373 and 375 naturally come in close surface contact with the end portions of the upper plates of the first and second cabinets when being fastened to the partition panel 350 to form an airtight seal.

Further, an additional link member is used to be fastened to the lower end portion of the partition panel 350, and in this case, the end portions of the lower plates of the first and second cabinets come in close surface contact with the partition panel 350 to form an airtight seal.

On the other hand, in the case of separating any one of the upper plates 329 and 349, the link member 370 is completely separated from the upper end of the partition panel 350, and then the upper plate is separated from the left and right plates to simply complete the upper plate separation work. Because a small number of fixing screws are used on the upper plates 329 and 340 in comparison to that in the related art, the upper plate separation work can be performed very promptly.

Figure 13:
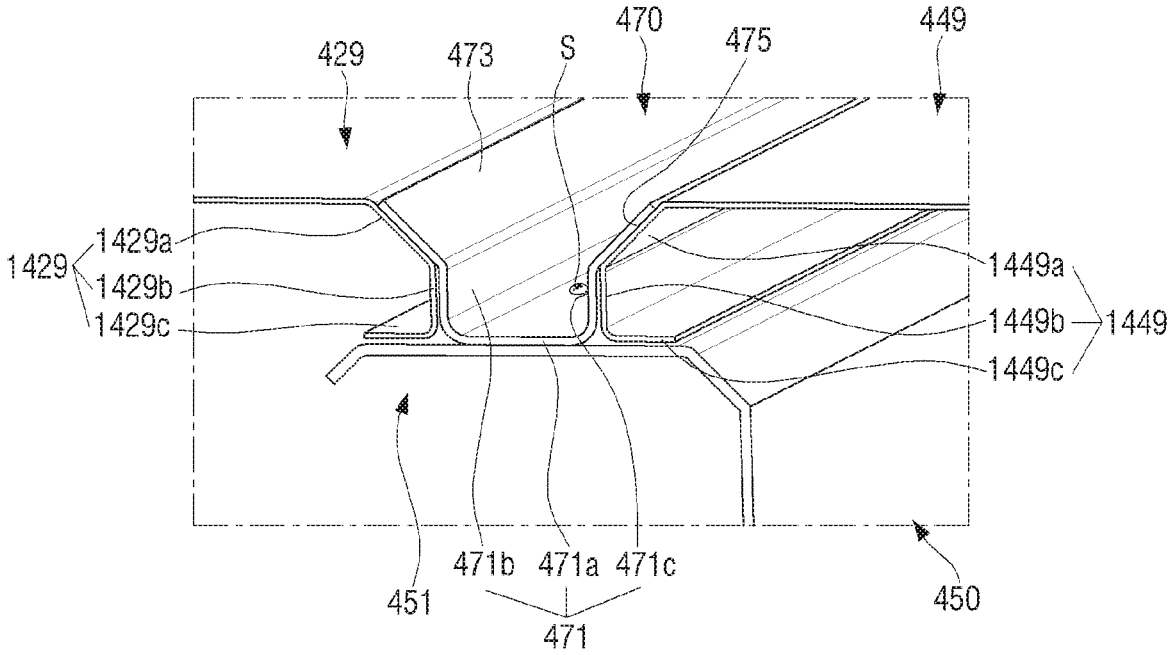

Referring to FIG. 13, a link member 470 comes in close surface contact with peripheral connection portions to form multiple airtight points.

That is, the link member 470 includes a center portion 471 that is bent into three parts 471*a*, 471*b*, and 471*c* to form a groove, and first and second extension portions 473 and 475 in a flat plate shape, which are formed on both sides of the center portion 471 to be upwardly inclined. A part 471*a* of the center portion 471 is fastened along an upper end portion of a partition panel 450 by at least two fixing screws S in a state where it comes in close contact with the upper end portion 451.

Upper plates 429 and 449 of first and second cabinets include bent portions 1429 and 1449 that are formed to extend toward the link member 470.

In this case, the bent portion 1429 of the upper plate 429 of the first cabinet includes a first portion 1429*a* that comes in close contact with the first extension portion 473 of the link member 470, a second portion 1429*b* which extends from the first portion 1429*a* and comes in close contact with the part 471*b* of the center portion 471 of the link member 470, and a third portion 1429*c* which extends from the second portion 1429*b* and comes in close contact with the upper end portion 451 of the partition panel 450.

Further, the bent portion 1449 of the upper plate 449 of the second cabinet includes a first portion 1449*a* that comes in close contact with the second extension portion 475 of the link member 470, a second portion 1449*b* which extends from the first portion 1449*a* and comes in close contact with the part 471*c* of the center portion 471 of the link member 470, and a third portion 1449*c* which extends from the second portion 1449*b* and comes in close contact with the upper end portion 451 of the partition panel 450.

As described above, in the case of adopting the link member 470, multiple airtight points can be secured, and it is possible to intercept leakage of air in the first and second cabinets between the bent portions 1329 and 1349 of the first and second upper plates 329 and 349 to an outside.

Further, although not illustrated in the drawing, groove portions are formed on rear end portions of the upper plates 429 and 449, and locking portions that are formed on the first and second frames are circumscribed and inserted into the groove portions. In this case, the locking portions may form multiple airtight points on inner surfaces of the groove portions.

On the other hand, it is described that the link member 470 is installed only on the upper end portion of the partition panel 450, but is not limited thereto. The link member 470 may also be separably installed on a lower end portion of the partition panel 450 through an additional link member (not illustrated). In this case, the additional link member has the same structure as that of the link member 470 as described above, and one end portion of each lower plate (not illustrated) that comes in contact with the additional link member has the same airtight structure as that formed between the above-described link member 470 and the upper plates 429 and 449. Further, the other end portions of the lower plates may have the same airtight structure as that formed between the rear end portions of the upper plates 429 and 449 and the frames.

On the other hand, because the cooling performance of the duct type air conditioning apparatus is deteriorated in the case where air that is cooled by the heat exchanger in the second cabinet leaks, it is more important to intercept air leakage in the second cabinet having the built-in heat exchanger 131 rather than to intercept air leakage in the first cabinet. In consideration of this, a link member 570 may be adopted in a duct type air conditioning apparatus 100.

Because an air conditioning apparatus that adopts the link member 570 has the same assembling and disassembling processes as those of an air conditioning apparatus that adopts the link member 370 as described above, the explanation thereof will be omitted.

Figure 14:
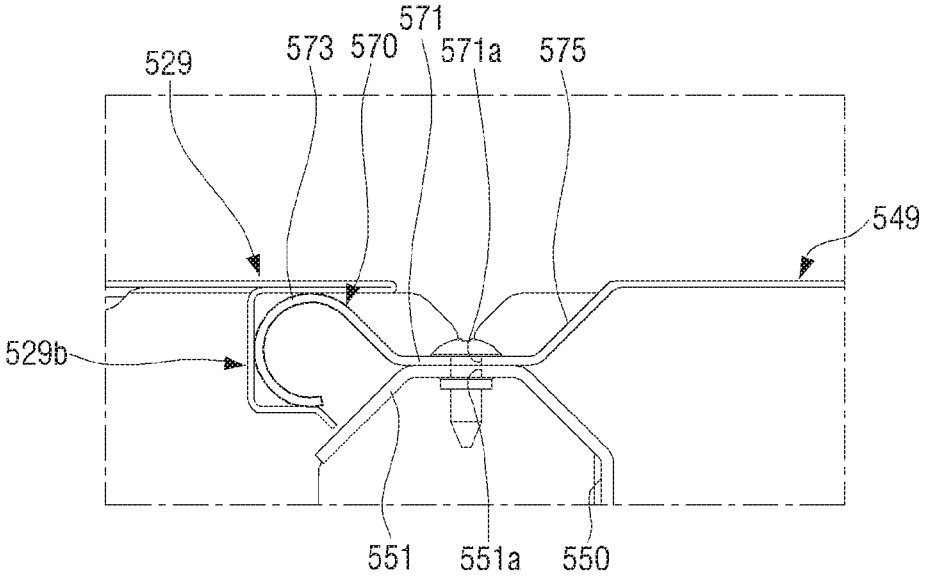

Referring to FIG. 14, the link member 570 includes a center portion 571 and first and second extension portions 573 and 575 formed on both sides of the center portion 571. In this case, like the first extension portion 273 of the link member 270, the first extension portion 573 is formed to be curved with a predetermined curvature in a winding shape.

The second extension portion 575 is formed to be inclined upward in a flat plate shape, and is integrally connected to the upper plate 549 of the second cabinet. Accordingly, the upper plate 529 of the first cabinet has a first groove portion 529*b* into which the first extension portion 573 is inserted, but the upper plate 549 of the second cabinet omits the first groove portion.

On the other hand, at least two screw holes 571*a* and 551*a* are formed on the center portion 571 of the link member 570 and the upper end portion 551 of the partition panel 550 so that fixing screws are fastened to the screw holes 571*a* and 551*a*.

As described above, because the upper plate 549 of the second cabinet in which the heat exchanger 131 is arranged and the second extension portion 575 of the link member 570 are integrally formed, the leakage of air in the second cabinet can be effectively intercepted.

Further, in the case of using the link member 570, multiple airtight points can be secured between the first extension portion 573 of the link member 570 and the first groove portion 529*b* formed on the upper plate 529 of the first cabinet.

In this case, although not illustrated in the drawing, groove portions are formed on rear end portions of the upper plates 529 and 549, and locking portions that are formed on the first and second frames are circumscribed and inserted into the groove portions. In this case, the locking portions may form at least three airtight points on inner surfaces of the groove portions.

On the other hand, it is described that the link member 570 is installed only on the upper end portion of the partition panel 550, but is not limited thereto. The link member 570 may also be separably installed on a lower end portion of the partition panel 550 through an additional link member (not illustrated). In this case, the additional link member has the same structure as that of the link member 570 as described above, and one end portion of the lower plate (not illustrated) that comes in contact with the additional link member has the same airtight structure as that formed between the above-described link member 570 and the upper plates 529 and 549. Further, the other end portion of the lower plate may have the same airtight structure as that formed between the rear end portions of the upper plates 529 and 549 and the frames.

In the case of an air conditioning apparatus that adopts the link member 570, a method for assembling first and second cabinets is as follows.

First, the partition panel 550 is fastened to any one of the first and second cabinets by fixing screws.

Then, the remaining cabinet is moved along the same plane toward the cabinet to which the partition panel 550 has been fastened so that the remaining cabinet faces the partition panel 550, and then the remaining cabinet is connected to the partition panel 550 through the remaining fixing screws.

In this state, the upper plates 529 and 549 of the first and second cabinets are fastened to upper ends of left and right plates of the first and second cabinets. In this case, because one 549 of the upper plates 525 and 549 of the first and second cabinets is integrally formed with the link member 570, fastening of the link member can be omitted.

In addition, in the case of the air conditioning apparatus that adopts the link member 570 of the present disclosure, the link member 570 comes in close contact with one end portion of the upper plate 529 that is not integrally formed with the link member 570 during fastening of the upper plates 529 and 549, and thus an airtight seal is made at multiple points.

Further, the lower plates of the first and second cabinets are also fastened to the left plate and the right plate through the same process as that of the upper plates 525 and 549.

On the other hand, a process of separating the upper plates 529 and 549 from the first and second cabinets in the air conditioning apparatus that adopts the link member 570 of the present disclosure is as follows.

First, in the case of separating one 549 of the upper plates 529 and 549, which is integrally formed with the link member 570, fixing screws that fasten the upper plate 549 and the left and right plates are disassembled, and then the link member 570 is drawn from the groove portion 529*c* of the other upper plate 529 to complete a separation work. After the upper plate 549 that is integrally formed with the link member 570 is separated from the second cabinet, the upper plate 529 can be easily separated from the first cabinet by disassembling the fixing screws that fasten the upper plate 529 that is not provided with the link member 570 and the left and right plates.

It is described that the same link members are used on the upper end portions and the lower end portions of partition panels 150, 250, 350, 450, and 550, but is not limited thereto. It is also possible to mixedly use link members 170,

270, 370, 470, and 570. For example, in the case of the upper plate to be separated from the cabinet for repair and maintenance after the air conditioning apparatus 100 is installed to be embedded in the ceiling, the link members 170 and 270, while in the case of the lower plate that is not frequently opened in comparison to the upper plate, any one of the link members 370, 470, and 570 may be adopted.

Further, although not illustrated, it is also possible to produce the upper and lower plates that form an airtight structure with each frame so as to form multiple airtight points through surface contact among the link members 370 and 470, the upper plates, and the partition panel instead of the airtight structure through the groove portions and the locking portions of the respective frames.

While the disclosure has been shown and described with reference to certain embodiments thereof, it will be understood by those skilled in the art that various changes in form and detail may be made therein without departing from the spirit and scope of the present disclosure, as defined by the appended claims.

What is claimed is:

1. A method of assembling an air conditioning apparatus, comprising:

connecting a first cabinet configured to house first and second blowing assemblies of the air conditioning apparatus and a second cabinet configured to house a heat exchanger of the air conditioning apparatus with a partition panel that partitions an interior of the first cabinet from an interior of the second cabinet and that forms first and second discharge ports separated from each other so that, when the first and second blowing assemblies are housed in the first cabinet and the heat exchanger is housed in the second cabinet, air blown by the first and second blowing assemblies respectively passes through the first and second discharge ports to the heat exchanger;

inserting a link member into a groove portion formed on a first end of an upper plate of the first cabinet; and separably fastening the link member, by a fastener, along an upper portion of the partition panel so that the link member is provided between an outermost surface of the partition panel and an exterior of both the first cabinet and the second cabinet, wherein the link member comprises a center portion separably connectable to the partition panel, a first extension portion extending toward the first cabinet, and a second extension portion extending toward the second cabinet, and the method further comprises moving the link member toward the partition panel, while the link member is inserted into the groove portion, wherein the groove portion rotates with respect to a second end of the upper plate of the first cabinet formed on an opposite side of the groove portion when the link member moves toward the partition panel.

2. The method as claimed in claim 1, wherein the link member is at least partially circumscribed by the groove portion.

3. The method as claimed in claim 2, wherein the link member is at least partially circumscribed by a groove portion formed on the second cabinet, and the method further comprising:

inserting the link member into the groove portion formed on the second cabinet, and moving the link member toward the partition panel, while the link member is inserted into the groove portion formed on the second cabinet.

4. The method as claimed in claim 1, further comprising:

inserting a locking portion of the first cabinet into an additional groove portion formed on the upper plate of the first cabinet.

5. The method as claimed in claim 1, wherein the upper portion of the partition panel longitudinally extends above the first and second discharge ports.

* * * * *